US009498876B2

(12) United States Patent
Schubert

(10) Patent No.: US 9,498,876 B2
(45) Date of Patent: Nov. 22, 2016

(54) COLLAPSIBLE HOLDING ARRANGEMENT

(71) Applicant: Hilti Aktiengesellschaft, Schaan (LI)

(72) Inventor: Wolfgang Schubert, Landsberg (DE)

(73) Assignee: HILTI AKTIENGESELLSCHAFT, Schaan (LI)

( * ) Notice: Subject to any disclaimer, the term of this patent is extended or adjusted under 35 U.S.C. 154(b) by 0 days.

(21) Appl. No.: 14/812,551

(22) Filed: Jul. 29, 2015

(65) Prior Publication Data

US 2015/0328765 A1 Nov. 19, 2015

Related U.S. Application Data

(63) Continuation of application No. PCT/EP2014/051618, filed on Jan. 28, 2014.

(30) Foreign Application Priority Data

Jan. 31, 2013 (DE) ..... 10 2013 201 620

(51) Int. Cl.

| | |
|---|---|
| ***A45C 13/22*** | (2006.01) |
| ***B25G 3/00*** | (2006.01) |
| ***B25F 5/02*** | (2006.01) |
| ***B25G 3/02*** | (2006.01) |
| ***B25G 1/10*** | (2006.01) |

(52) U.S. Cl.

CPC ..... *B25F 5/026* (2013.01); *B25G 1/10* (2013.01); *B25G 3/02* (2013.01); *Y10T 16/4713* (2015.01)

(58) Field of Classification Search

CPC . Y10T 16/469; Y10T 16/4713; A01B 1/026; B25F 5/02; B25F 5/025; B25F 5/026; B25B 13/52; B25D 17/04; B25D 17/043; B23B 45/001; B25G 1/002; B25G 1/005; B25G 1/102; B25G 1/10; B25G 3/00; B25G 3/02; B25G 3/18; B25G 3/20; B25G 3/24; B25G 3/26; B25G 3/28; B25G 3/30

See application file for complete search history.

(56) References Cited

U.S. PATENT DOCUMENTS

| | | | |
|---|---|---|---|
| 2009/0133889 | A1 | 5/2009 | Keller et al. |
| 2009/0283283 | A1 | 11/2009 | Oesterle et al. |

FOREIGN PATENT DOCUMENTS

| | | |
|---|---|---|
| DE | 102008043379 | 5/2010 |
| EP | 2065142 | 6/2009 |
| EP | 2123406 | 11/2009 |

OTHER PUBLICATIONS

International Search Report for PCT/EP2014/051618, dated Jun. 2, 2014, 10 pages.

*Primary Examiner* — Chuck Mah

(74) *Attorney, Agent, or Firm* — McAndrews, Held & Malloy, Ltd.

(57) ABSTRACT

A holding device for a hand held power tool, in particular, an electric power tool, said holding device comprising an attachment component with at least one attachment element, which can be connected to the power tool; at least one spacer element; as well as a handle with a first handle end and a second handle end. Moreover, the holding device comprises a connecting device, by means of which the attachment component, the spacer element and the handle can be connected to each other.

19 Claims, 14 Drawing Sheets

COLLAPSIBLE HOLDING ARRANGEMENT

RELATED APPLICATIONS

This application claims priority to, and is a continuation of, International Application No. PCT/EP2014/051618 having an International filing date of Jan. 28, 2014, which is incorporated herein by reference, and which claims priority to German Patent Application No. 102013201620.4, having a filing date of Jan. 31, 2013, which is also incorporated herein by reference in its entirety.

BACKGROUND OF THE INVENTION

The invention relates to a holding device for a hand held power tool, in particular, an electric power tool. The holding device comprises an attachment component with at least one attachment element, which can be connected to the power tool; at least one spacer element as well as a handle with a first handle end and a second handle end.

BRIEF DESCRIPTION OF THE DRAWINGS

The drawings show in

DETAILED DESCRIPTION OF THE INVENTION

Figure 1:
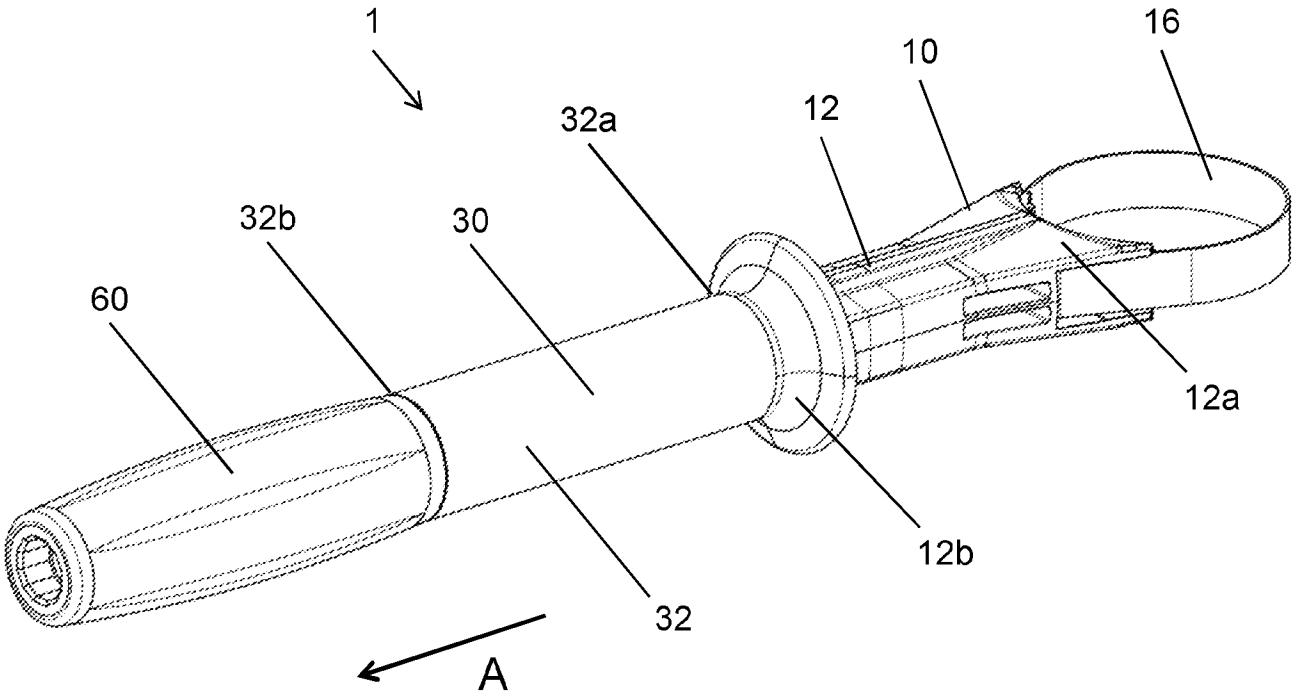
FIG. 1 a perspective view of the assembled state of the inventive holding device comprising an attachment component with an attachment element, a spacer element and a handle.
Figure 2:
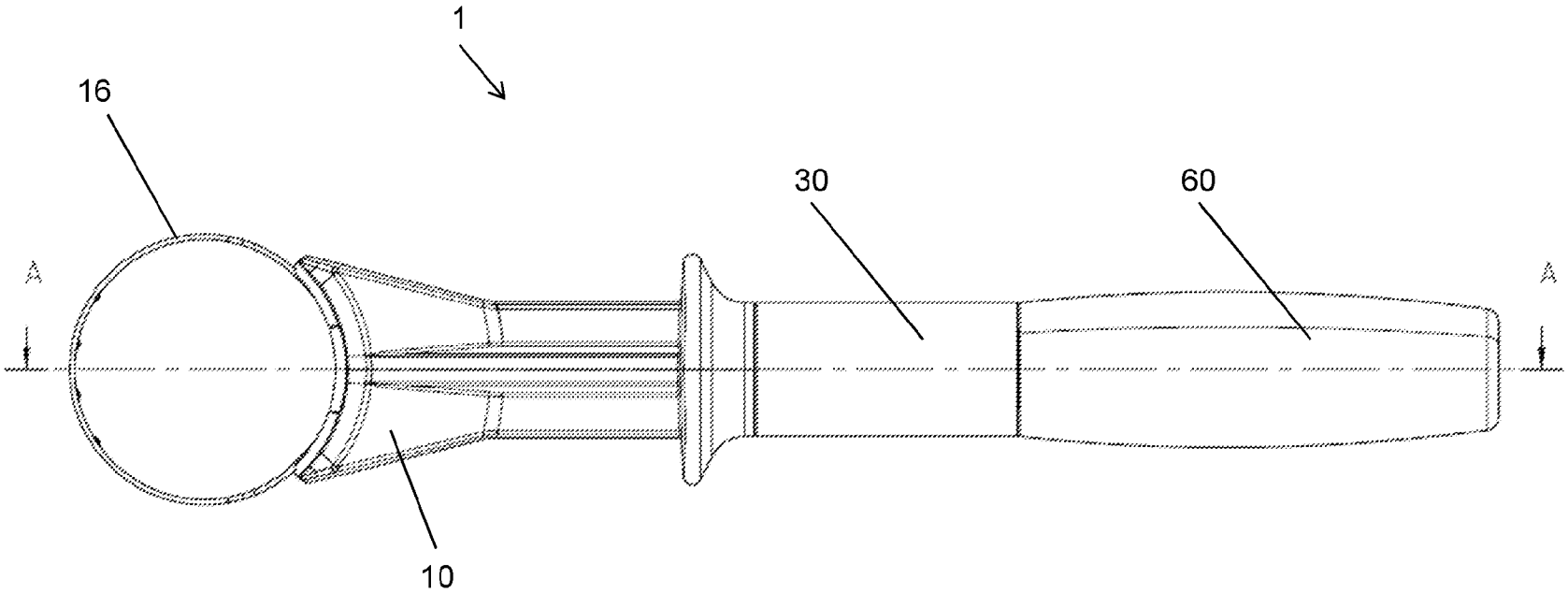
FIG. 2 a plan view of the holding device according to the invention.

An (auxiliary) holding device or more specifically an auxiliary handle for a hand held power tool usually has an attachment piece and a handle piece. In this case the attachment piece comprises, for example, a steel band, which is designed as a ring-shaped bow and has a diameter that can be made smaller, as required. The steel band is placed around a so called clamping neck of the power tool and is clamped on the clamping neck by suitably decreasing the diameter of the bow. As an alternative, the attachment piece can also have a threaded connection, by means of which the holding device can be screwed to the power tool. The holding device gives a user of the power tool an additional holding option.

Holding devices of this type are shown in the documents of the prior art EP 1 099 517 A2 and EP 1 779 981 A1. The document EP 1 099 517 A2 discloses, in particular, an electric power tool with an auxiliary handle, which is attached to the clamping neck of the electric power tool by means of a ring shaped attachment piece. In contrast, EP 1 779 981 A1 discloses an electric power tool, in which an auxiliary handle is attached to the housing of the electric power tool by means of a threaded connection.

One drawback of power tools or more specifically electric power tools with holding devices or more specifically with auxiliary handles in accordance with the state of the art lies in their handling. Prior to using a power tool or more specifically an electric power tool, the holding device or more specifically the auxiliary handle usually has to be positioned and then attached to the electric power tool. This is the case, especially if the electric power tool is taken out of its packaging, for example, its carrying case or box, in which it is kept separate from the holding device during transport or in which it is stored between two applications, in order to protect it.

After the electric power tool has been used, the holding device is correspondingly removed again, in order to house the electric power tool and the holding device separately again in the packaging. Removing the holding device from the electric power tool is absolutely mandatory, especially if it is not possible to store the electric power tool together with the mounted holding device in the packaging for space reasons. According to the state of the art, it is possible to change the position of the holding devices relative to the electric power tool by rotating the ring-shaped attachment piece or also to completely remove the holding devices from the electric power tool, in order to make it even possible at all to store said holding devices in the packaging. Due to the (excess) length of the holding device, the situation may arise that even if the holding tool is rotated, the electric power tool still cannot be stored with the mounted holding device in the packaging, because the holding device may collide with a component of the electric power tool (for example, a base or a battery of the electric power tool) or cannot be placed flat enough in a plane with the electric power tool. Consequently the user is forced to completely disassemble the holding device from the electric power tool. However, the complete disassembly of the holding device from the electric power tool has often proven to be cumbersome and time consuming, so that the user frequently avoids using the holding device in connection with the electric power tool all together and, instead, uses the electric power tool without the holding device. However, this situation can lead to a potential risk to the user when using the electric power tool.

One object of the present invention is to remedy the aforementioned drawback and, in so doing, to provide a holding device for a hand held power tool, in particular, an electric power tool that ensures an easy and safe use of an electric power tool together with a holding device.

This engineering object is achieved, according to the invention, by means of a holding device for a hand held power tool, in particular, an electric power tool. For this purpose the holding device comprises an attachment component with at least one attachment element, which can be connected to the power tool, at least one spacer element as well as a handle with a first handle end and a second handle end.

The invention provides at least one connecting device, by means of which the attachment component, the spacer element and the handle can be connected to each other. In this case the connecting element ensures that the attachment component, the spacer element and the handle can be securely connected to each other by choice, in order to provide in this way a stable holding device for holding the power tool for the user. Moreover, the connecting element makes it possible to release the secure connection of the attachment component, the spacer element and the handle, so that these components of the holding device can be positioned relative to each other and, as a result, can be put away in an optimum manner or more specifically in a space saving manner.

According to an additional embodiment of the present invention, it can be provided that the connecting device may comprise a first connecting device end, a second connecting device end and a flexible connecting element. In addition, it is also possible for the flexible connecting element to be positioned between the first connecting device end and the second connecting device end. The flexible connecting element makes it possible for the attachment component, the spacer element and the handle to remain attached to each other in a variable manner, so that it is even easier to position the components of the holding device relative to the electric power tool. The flexible connecting element may be implemented by means of a steel cable or by means of a chain. However, it is also possible to use any other device that lends itself to the flexible connection of the individual components of the holding device.

In order to achieve a connection between the connecting device and the attachment element, it can be provided that the first connecting device end can be connected to the attachment element.

Moreover, according to another embodiment of the present invention, it can be provided that the second connecting device end can be connected to the handle. As a result, a connection between the connecting device and the handle is achieved.

Furthermore, it is also possible that the second connecting device end comprises at least a first section and a second section. Owing to the first section and the second section at least two functions can be achieved by means of the second connecting device end.

The first section of the second connecting device end can comprise a first component of a threaded connection; and the first handle end can comprise a second component of the threaded connection. In this case the first component of the threaded connection can be designed as a threaded screw, and the second component of the threaded connection can be designed as a bore with an internal thread that corresponds to the threaded screw. This arrangement ensures that the connecting device and the handle can be connected to each other in such a way that this connection can be released again. At the same time this arrangement ensures that the connecting device and the handle will move towards each other when the threaded connection is tightened.

According to an additional embodiment of the present invention, it can be provided that the spacer element comprises a through bore. The through bore is formed in such a way that the flexible connecting element of the connecting device can be accommodated.

Furthermore, it may be provided that the through bore comprises at least a first section and a second section. Owing to the first section and the second section of the through bore at least two functions can be achieved by means of the through bore.

Moreover, according to an additional embodiment of the present invention, it can be provided that the first section of the through bore comprises a round bore; and the second section of the through bore comprises a multi-faceted bore. The multi-faceted bore is used, in particular, to provide a resistance to a rotation of an object or rather a component, which is located in the second section of the through bore, and at the same time to allow an axial displacement of this object or rather this component along the through bore. In this case the multi-faceted bore can be implemented by means of a rectangular profile or also by means of any other suitable profile.

In addition, it is possible that the second section of the second connecting device end has a multi-faceted cylindrical shape corresponding to the multi-faceted bore of the second section of the through bore. The corresponding shapes of the second section of the second connecting device end and the multi-faceted bore of the second section of the through bore make it possible to prevent the second section of the second connecting device end and the multi-faceted bore of the second section of the through bore from being able to rotate relative to each other. At the same time, however, it is also ensured that the second section of the second connecting device end and the multi-faceted bore of the second section of the through bore can be displaced relative to each other in the axial direction.

Other advantages will become apparent from the following description of the drawings. The drawing shows one embodiment of the present invention. The drawings, the description and the claims include a number of features in combination. For reason of expedience the person skilled in the art will also consider the features individually and combine them into additional, logical combinations.

FIGS. 1 to 6 shows a holding device 1 for a hand held power tool, in particular, an electric power tool. The power tool is not shown. The electric power tool can be specifically a drill, a saw, a planer or the like.

Figure 6:
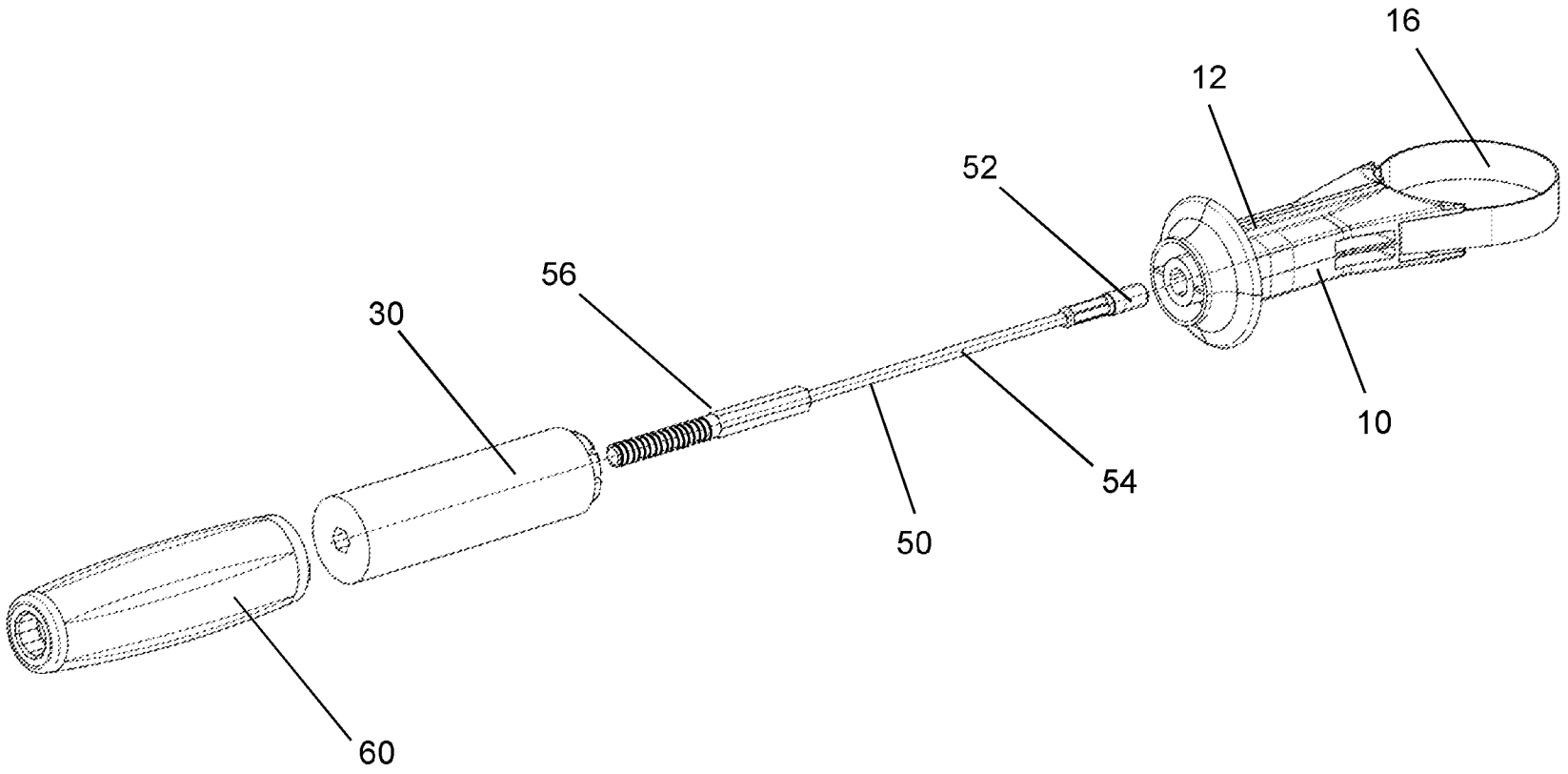
FIG. 6 an exploded drawing of the inventive holding device comprising the attachment component with the attachment element, the connecting device, the spacer element and the handle.

As shown, in particular, in FIG. 6, the holding device 1 comprises an attachment component 10, a spacer element 30, a connecting device 50 and a handle 60.

Figure 7:
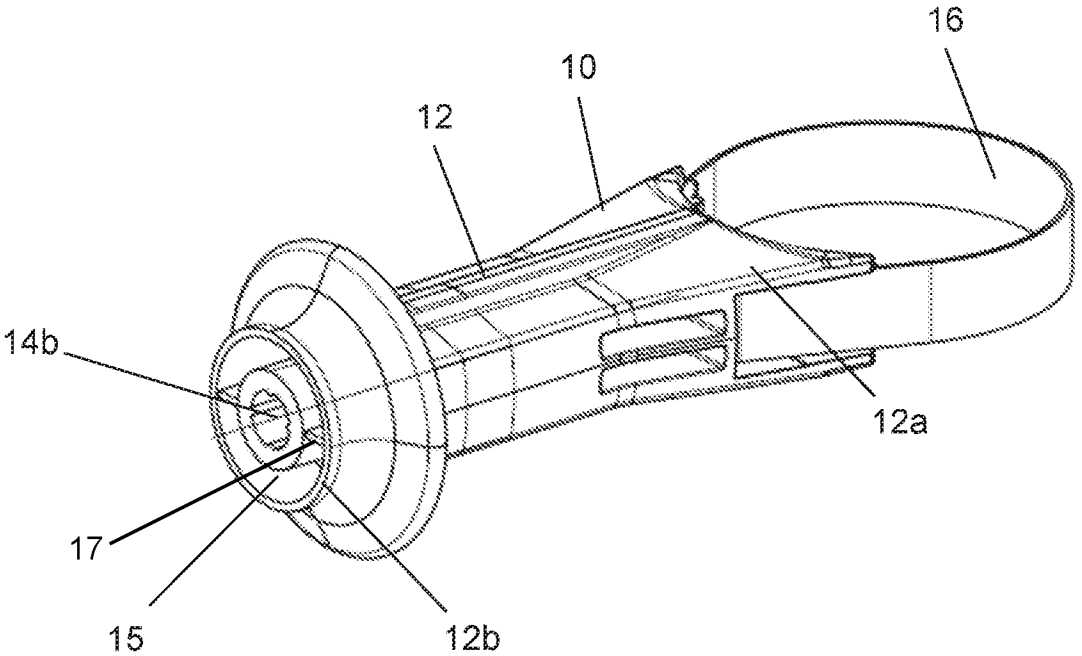
FIG. 7 a perspective view of the attachment component.

The attachment component 10 in turn comprises a base body 12 and an attachment element 16. The base body 12 comprises a first end 12*a*, a second end 12*b* and a through bore 14, which has a first opening 14*a* and a second opening 14*b* (see FIGS. 3, 5, 6, and 7). In addition, the second end 12*b* of the base body 12 also comprises a ring-shaped groove 15 and a tab 17 in the ring-shaped groove 15 (see FIGS. 6 and 7). The attachment element 16, which is implemented in the form of a loop element, comprises a first loop end 16*a* and a second loop end 16*b*. Moreover, the loop element 16 is connected to the base body 12 in such a way that the first loop end 16*a* and the second loop end 16*b* are inserted into the first opening 14*a* of the through bore 14. As a result, the loop element 16 forms a circular loop on the first end 12*a* of the base body 12.

As shown in FIGS. 9, 10, 11 and 12, the spacer element 30 comprises a cylindrical base body 32 having a first end 32*a*, a second end 32*b*, and a through bore 34. On the first end 32*a* of the spacer element 30 there are eight circularly arranged segments 36, which are formed in such a way that they can engage tab 17 when inserted into the ring-shaped groove 15 and can be held by the latter. The through bore 34 comprises a first section 35 and a second section 38. In this case the first section 35 has a round bore 37. The second section 38 has a hexagonal bore 39. However, it is also possible for the second section 38 to have any shape that is different from that of a hexagonal bore 39.

Figure 3:
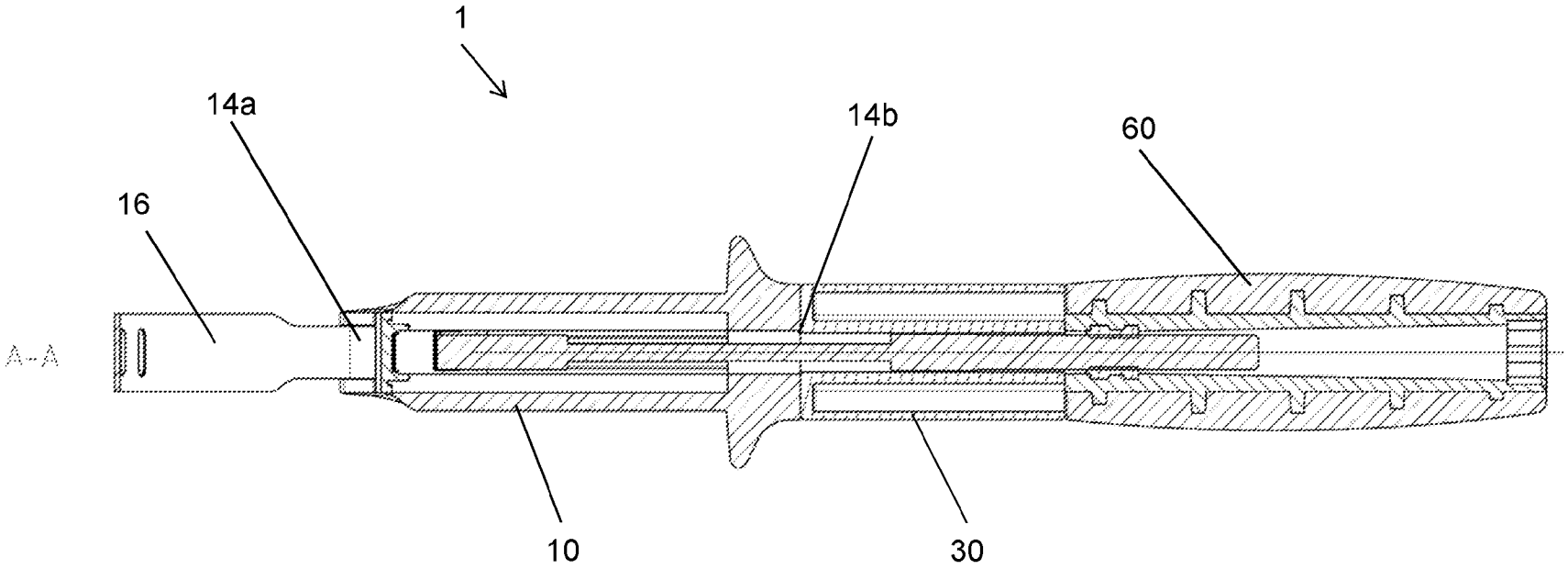
FIG. 3 a sectional view along the line A-A in FIG. 2.
Figure 4:
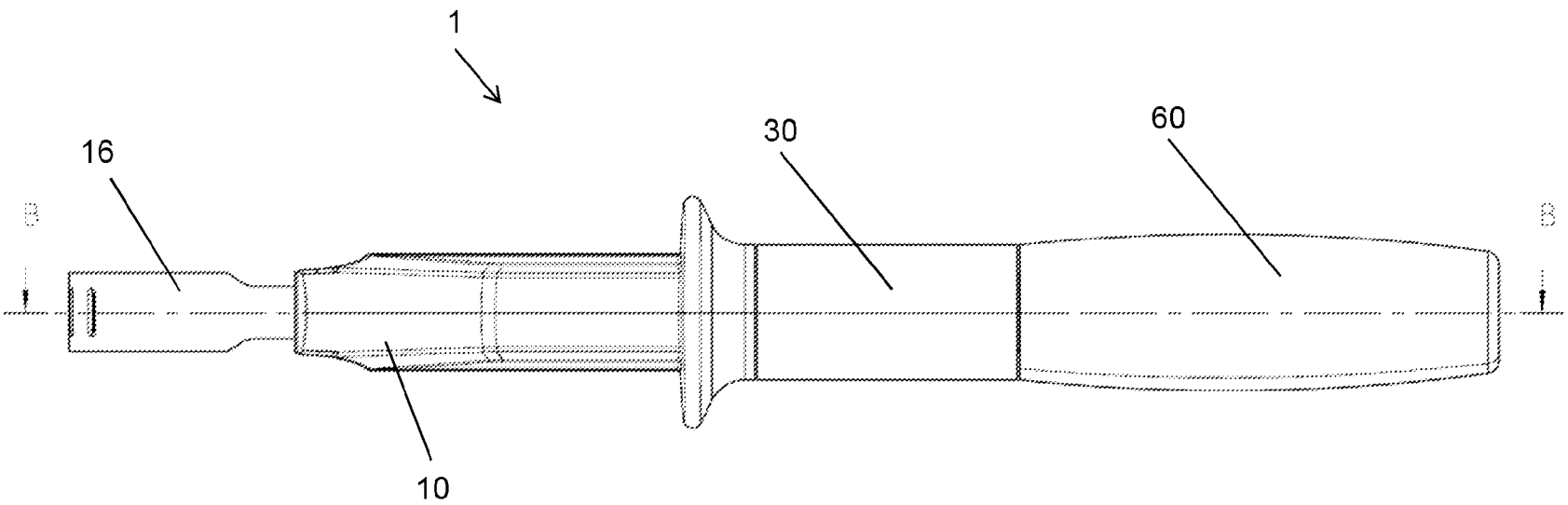
FIG. 4 a side view of the holding device according to the invention.
Figure 5:
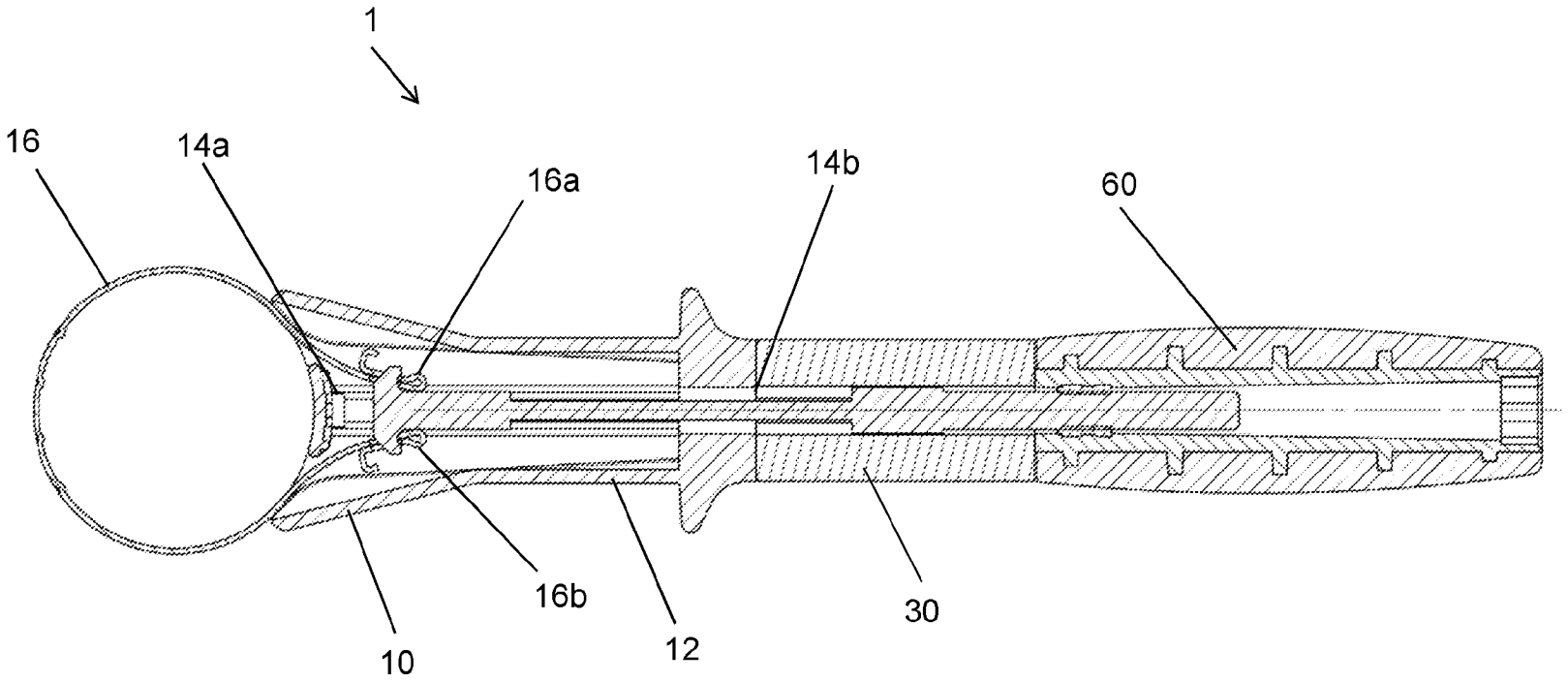
FIG. 5 a sectional view along the line B-B in FIG. 4.
Figure 8:
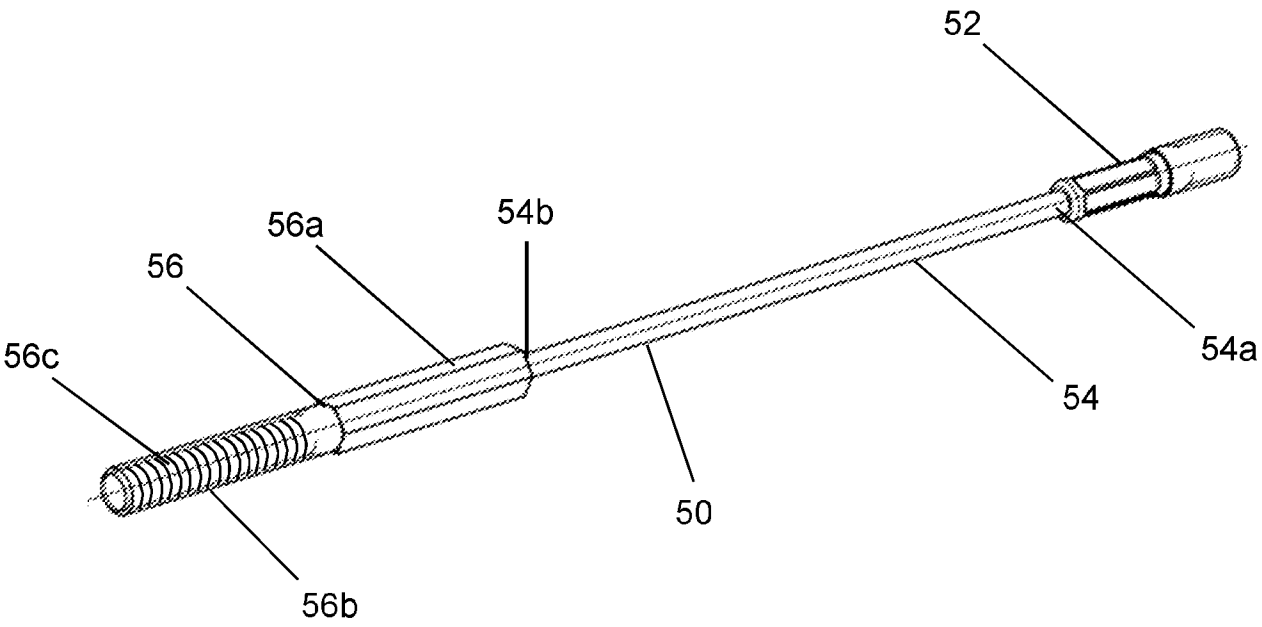
FIG. 8 a perspective view of the connecting device.
Figure 9:
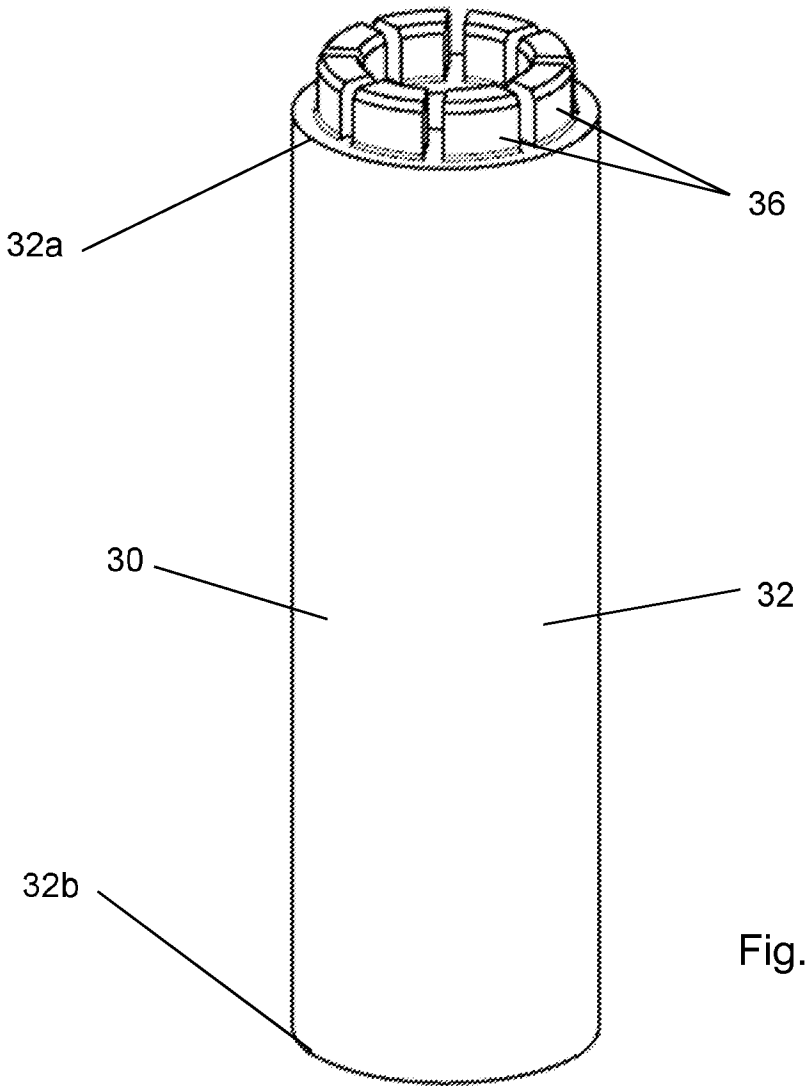
FIG. 9 a perspective view of the spacer element with the first end of the spacer element.
Figure 10:
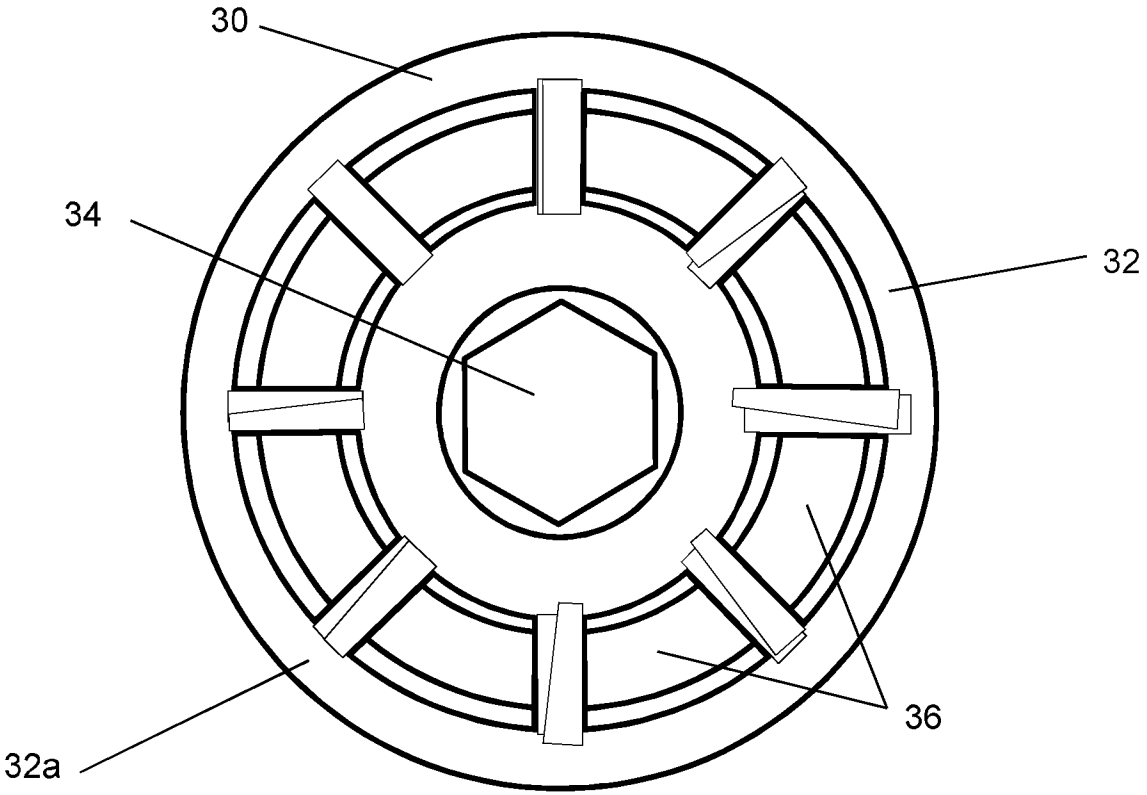
FIG. 10 a plan view of the first end of the spacer element.
Figure 11:
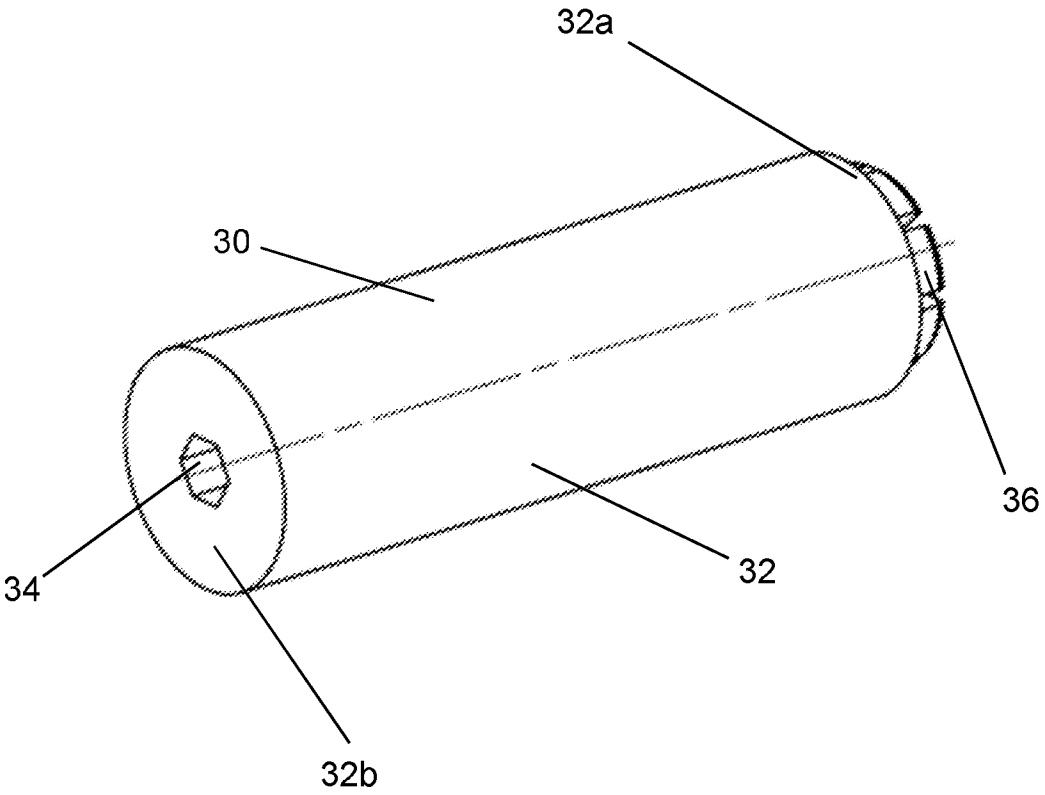
FIG. 11 a perspective view of the spacer element with the second end of the spacer element.
Figure 12:
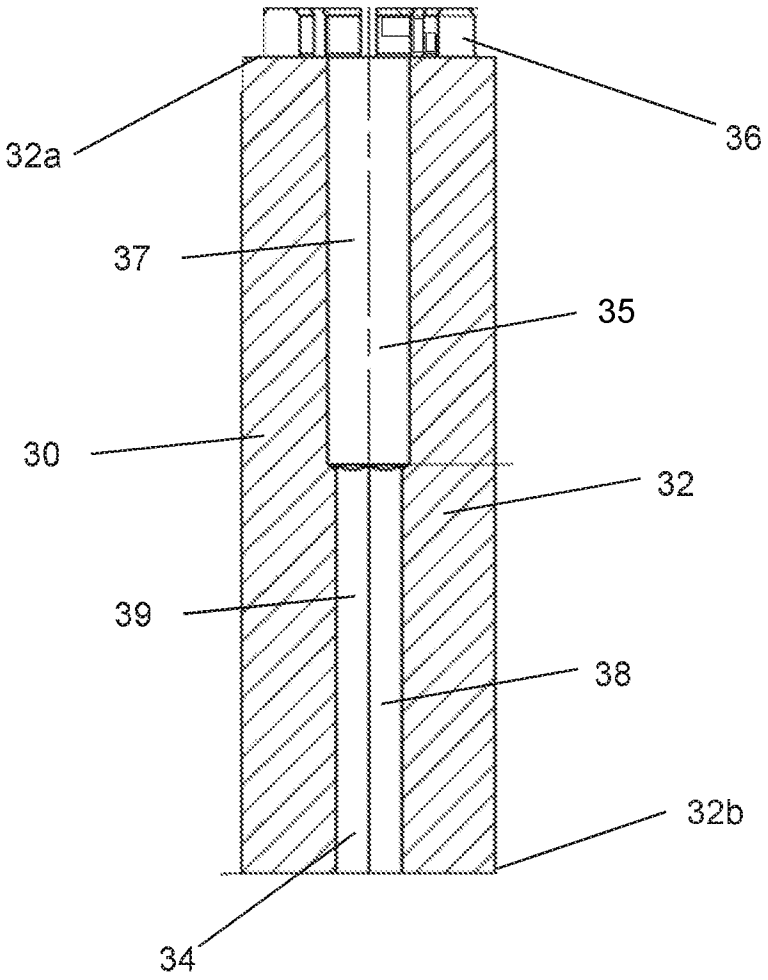
FIG. 12 a sectional view along the spacer element.

The connecting device 50, shown in FIGS. 3, 5, 6 and 8, comprises a first connecting device end 52 in the form of a first terminal, a connecting element 54 in the form of a steel cable, and a second connecting device end 56 in the form of a second terminal. The steel cable 54 is connected to the first terminal 52 and the second terminal 56 in such a way that it is secure against rotation. The first terminal 52 is attached to the first and second loop end 16*a*, 16*b*. FIGS. 3 and 5 show a first embodiment of the first terminal 52; and FIGS. 6 and 8 show a second embodiment of the first terminal 52.

The steel cable 54 has a first end 54*a* and a second end 54*b*. The first end 54*a* is connected to the first terminal 52 in a rotationally rigid manner; and the second end 54*b* is connected to the second terminal 56 in a rotationally rigid manner.

The second terminal 56 comprises a first section 56*a* and a second section 56*b*. The first section 56*a* is designed in the form of a hexagonal cylinder, which can be inserted into the hexagonal bore 39. The second section 56*b* is designed in the form of a round cylinder having a thread 56*c*. As a result, the second section 56*b* has there a first component of a threaded connection 58.

Figure 13:
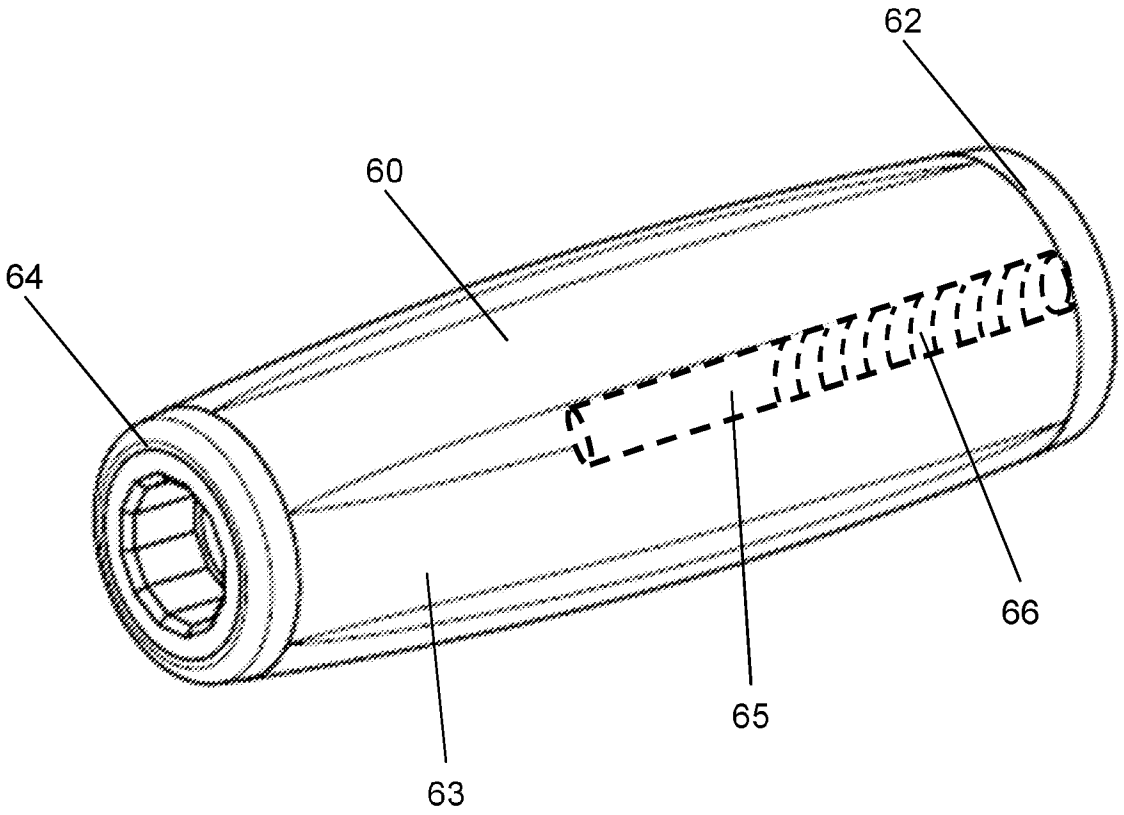
FIG. 13 a perspective view of the handle with the first handle end.

As shown in FIG. 13, the handle 60 comprises a first end 62 and an elongated base body 63 as well as a second end 64. In addition, the elongated base body 63 also has a bore 65 with an internal thread 66. As a result, the internal thread 66 has there a second component of the threaded connection 58.

Figure 14:
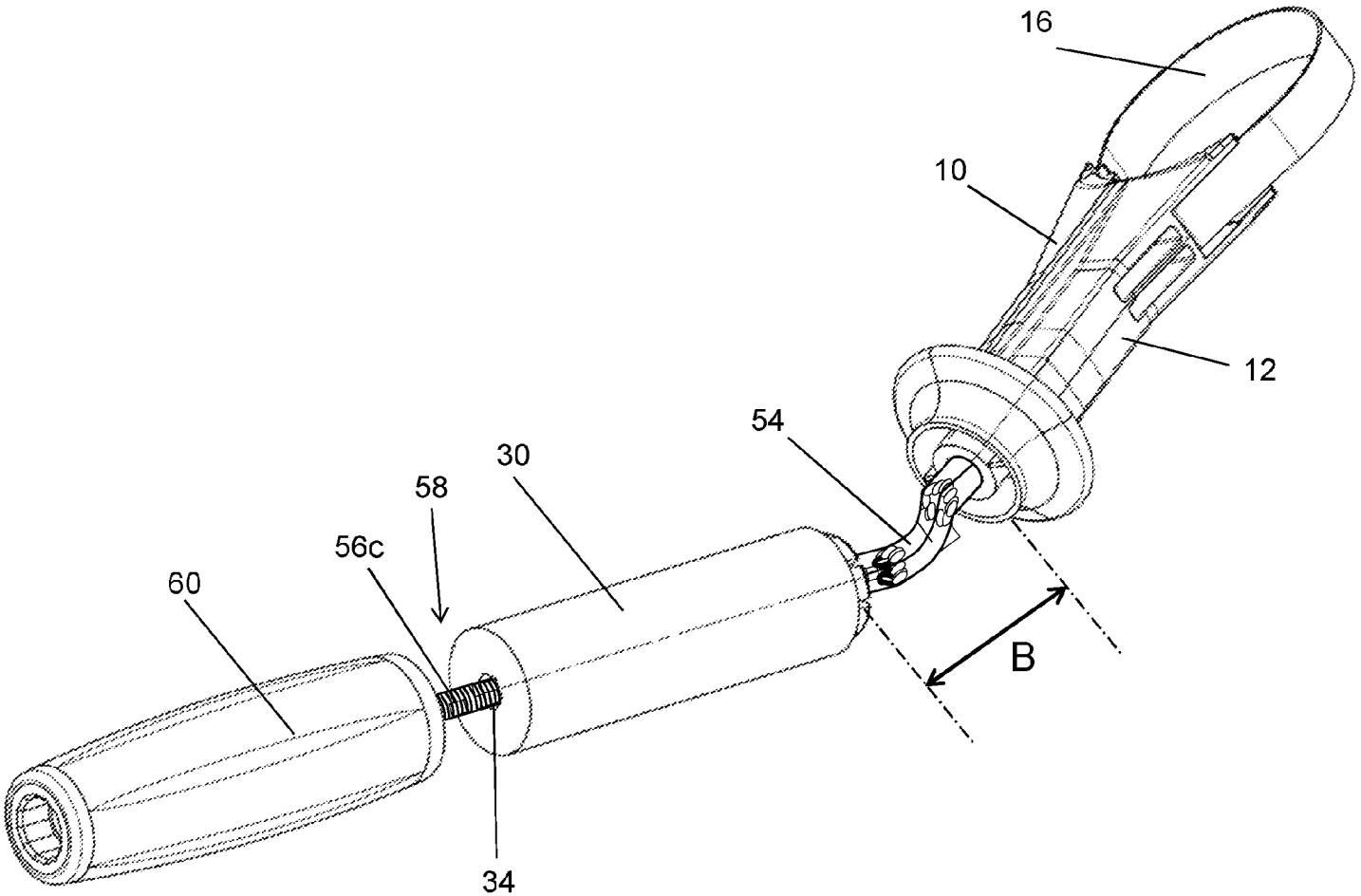
FIG. 14 a perspective view of the inventive holding device in which the attachment component, the spacer element, and the handle are joined by means of the connecting device.

According to the drawing in FIG. 14, the attachment component 10, the spacer element 30 and the handle 60 are joined to the holding device 1 by means of the connecting device 50.

As already mentioned above, the loop element 16 is connected at the same time to the base body 12 of the attachment component 10 in such a way that the first loop end 16*a* and the second loop end 16*b* are inserted into the first opening 14*a* of the through bore 14 and are held there accordingly by the first terminal 52 of the connecting device 50.

The steel cable 54 extends through the cylindrical base body 32 of the spacer element 30, so that the second terminal 56 of the connecting device 50 is connected to the handle 60. In so doing, the thread 56*c* of the second terminal 56 is screwed into the bore 65 with an internal thread 66. The first section 56*a* of the second terminal 56 is positioned in the hexagonal bore 39 of the through bore 34, so that even though this first section 56*a* can be moved in the axial direction in the bore 39, it cannot be rotated due to the hexagonal shape.

The base body 32 of the spacer element 30 is connected with a first end 32*a* to the first end 12*a* of the base body 12 of the attachment component 10 in such a way that the circularly arranged segments 36 are held by the ring-shaped groove 15. In the assembled state according to FIG. 1, the second end 32*b* of the spacer element 30 is adjacent to the first end 62 of the handle 60.

By screwing the threaded connection 58, i.e., the thread 56*c* of the second terminal 56 with an internal thread 66 of the bore 65, the steel cable 54 of the connecting device 50 is pulled in the direction A relative to the spacer element 30 (see FIG. 1), as a result of which the first and second loop ends 16*a*, 16*b* are also pulled in the direction A relative to the attachment component 10 by means of the steel cable 54. By tightening the first and second loop ends 16*a*, 16*b* relative to the attachment component 10, the circular loop of the loop element 16 is made smaller, as a result of which the holding device 1 can be attached to a clamping neck (not shown) of a power tool in such a way that it is secure against rotation. The holding device 1, which is mounted in a rotationally rigid manner, makes it possible for a user to hold the power tool properly and, in particular, safely while using said power tool.

By screwing on the threaded connection 58, i.e., the thread 56*c* of the second terminal 56 against the internal thread 66 of the bore 65, the steel cable 54 of the connecting device 50 is pressed opposite to the direction A in relation to the spacer element 30 (see FIG. 1). As a result, the first and second loop ends 16*a*, 16*b* are also pressed by the steel cable 54 opposite to the direction A in relation to the attachment component 10. By pushing away the first and second loop ends 16*a*, 16*b* in relation to the attachment component 10, the circular loop of the loop element 16 is made larger, as a result of which the holding device 1 is released from the clamping neck (not shown) of the power tool. By releasing, the holding device 1 can be rotated relative to the power tool, which is not shown, and can even be disassembled by removing the now released holding device 1 from the clamping neck (not shown) of the power tool.

By screwing on the threaded connection 58, in particular, the distance between the attachment component 10 and the handle 60 is increased. In screwing on the threaded connection 58, however, the handle 60 should not be completely detached from the connecting device 50, so that the spacer element 30 and the handle 60 will still remain connected by means of the threaded connection 58. By increasing this distance, the spacer element 30 can be moved between the attachment component 10 and the handle 60, so that, in particular, the first end 32*a* of the spacer element 30 can be separated from the attachment component 10; and the base body 32 of the spacer element 30 can be moved along the connecting device 50. Due to the fact that there is now a certain distance B (see FIG. 14) between the attachment component 10 and the spacer element 30, but there is still the flexible steel cable 54 for connecting the attachment component 10 and the spacer element 30, the spacer element 30, which is still connected to the handle 60 by means of the threaded connection 58, can be moved or more specifically can be positioned relative to the attachment component 10. As a result, in particular, the spacer element 30, connected to the handle 60, can be swung away from the attachment component 10 and the power tool, which is not shown (see FIG. 14), in order to store the holding device 1 in the packaging of the power tool in a space saving manner.

In order to use the holding device 1 again on the power tool, which is not shown, the threaded connection 58 is tightened again by turning the handle 60, so that the distance B between the attachment component 10 and the spacer element 30 decreases again; and the first end 32*a* of the spacer element 30 is positioned again in the ring-shaped groove 15. By tightening the threaded connection 58, as already described above, the loop of the loop element 16 is made smaller again, so that the holding device 1 is attached again to the clamping neck (not shown) of the power tool device in such a way that said holding device is secure against rotation.

What is claimed is:

1. A holding device for a hand held power tool, said holding device comprising:

an attachment component with at least one attachment element for connecting to the power tool;

at least one spacer element;

a handle with a first handle end and a second handle end; and at least one connecting device configured to connect the attachment component, the spacer element, and the handle;

wherein a first end of the spacer element comprises a plurality of circularly arranged segments; and wherein a base body of the attachment component comprises a ring-shaped groove configured to receive the plurality of circularly arranged segments.

2. The holding device of claim 1, wherein the connecting device comprises a first connecting device end, a second connecting device end, and a flexible connecting element.

3. The holding device of claim 2, wherein the first connecting device end is configured to be connected to the attachment element.

4. The holding device of claim 3, wherein the second connecting device end is configured to be connected to the handle.

5. The holding device of claim 4, wherein the second connecting device end comprises at least a first section and a second section.

6. The holding device of claim 1, wherein the plurality of circularly arranged segments are configured to engage a tab in the ring-shaped groove.

7. A holding device for a hand held power tool, said holding device comprising:

an attachment component with at least one attachment element for connecting to the power tool;

at least one spacer element;

a handle with a first handle end and a second handle end; and at least one connecting device configured to connect the attachment component, the spacer element, and the handle;

wherein the connecting device comprises a first connecting device end, a second connecting device end, and a flexible connecting element;

wherein the first connecting device end is configured to be connected to the attachment element;

wherein the second connecting device end is configured to be connected to the handle;

wherein the second connecting device end comprises at least a first section and a second section;

wherein the second section of the second connecting device end comprises a first component of a threaded connection; and wherein the first handle end comprises a second component of the threaded connection.

8. The holding device of claim 7, wherein the spacer element comprises a through bore.

9. The holding device of claim 8, wherein the through bore comprises at least a first section and a second section.

10. The holding device of claim 7, wherein:

a first end of the spacer element comprises a plurality of circularly arranged segments; and a base body of the attachment component comprises a ring-shaped groove configured to receive the plurality of circularly arranged segments.

11. The holding device of claim 10, wherein the plurality of circularly arranged segments are configured to engage a tab in the ring-shaped groove.

12. A holding device for a hand held power tool, said holding device comprising:

an attachment component with at least one attachment element for connecting to the power tool;

at least one spacer element;

a handle with a first handle end and a second handle end; and at least one connecting device configured to connect the attachment component, the spacer element, and the handle;

wherein the spacer element comprises a through bore;

wherein the through bore comprises at least a first section and a second section;

wherein the first section of the through bore comprises a round bore; and wherein the second section of the through bore comprises a multi-faceted bore.

13. The holding device of claim 12, wherein the first section of the second connecting device end has a multi-faceted cylindrical shape corresponding to the multi-faceted bore of the second section of the through bore.

14. The holding device of claim 12, wherein:

a first end of the spacer element comprises a plurality of circularly arranged segments; and a base body of the attachment component comprises a ring-shaped groove configured to receive the plurality of circularly arranged segments.

15. The holding device of claim 14, wherein the plurality of circularly arranged segments are configured to engage a tab in the ring-shaped groove.

16. The holding device of claim 12, wherein the connecting device comprises a first connecting device end, a second connecting device end, and a flexible connecting element.

17. The holding device of claim 16, wherein the first connecting device end is configured to be connected to the attachment element.

18. The holding device of claim 17, wherein the second connecting device end is configured to be connected to the handle.

19. The holding device of claim 18, wherein the second connecting device end comprises at least a first section and a second section.

* * * * *